US005324136A

United States Patent [19]

Reymonet et al.

[11] Patent Number: 5,324,136

[45] Date of Patent: Jun. 28, 1994

[54] APPARATUS FOR SPREADING BONDING EMULSION OR SIMILAR MATERIAL FOR ROAD ASPHALT

[75] Inventors: Jean-Pierre Reymonet, Le Chesnay; Michel Perrin, Noisy le Grand; Clément Beatrix, St Christo en Jarez; Pierre Defontaine, Nantes, all of France

[73] Assignee: Colas S.A., Boulogne Billancourt, France

[21] Appl. No.: 685,952

[22] Filed: Apr. 17, 1991

[30] Foreign Application Priority Data

May 21, 1990 [FR] France ..... 90 06406

[51] Int. Cl.[5] ..... E01C 23/02; E01C 19/18

[52] U.S. Cl. ..... 404/107; 404/111

[58] Field of Search ..... 404/101, 102, 103, 108, 404/109, 110, 111, 75, 83, 86, 92; 298/24

[56] References Cited

U.S. PATENT DOCUMENTS

| | | | |
|---|---|---|---|
| 1,729,574 | 9/1929 | Finley | 404/111 X |
| 1,961,971 | 6/1934 | Ignace | 404/76 |
| 2,374,732 | 5/1945 | Colburn | 404/76 X |
| 3,202,359 | 8/1965 | Gill, Jr. | 239/1 |
| 3,245,329 | 4/1966 | Nagin et al. | 404/75 |
| 3,596,577 | 8/1971 | Chennels | 404/76 X |
| 3,891,585 | 6/1975 | McDonald | 404/44 X |
| 4,069,182 | 1/1978 | McDonald | 404/92 X |
| 4,124,325 | 11/1978 | Cutler | 404/118 X |
| 4,173,401 | 9/1978 | McDonald | 404/75 |
| 4,198,177 | 4/1980 | Ray, Jr. et al. | 404/83 X |
| 4,226,552 | 10/1980 | Moench | 404/92 |
| 4,274,586 | 6/1981 | Hill | 239/125 |
| 4,423,980 | 1/1984 | Warnock | 404/83 |
| 4,453,856 | 6/1984 | Chiostri et al. | 404/91 |
| 4,637,656 | 1/1987 | Medeot | 299/36 X |
| 4,676,690 | 6/1987 | Allen | 404/101 X |
| 4,678,363 | 7/1987 | Sterner | 404/92 X |
| 4,685,826 | 8/1987 | Allen | 404/119 X |
| 4,971,476 | 11/1990 | Guillon | 404/92 X |

FOREIGN PATENT DOCUMENTS

| | | | |
|---|---|---|---|
| 0109303 | 5/1984 | European Pat. Off. . | |
| 0292337 | 11/1988 | European Pat. Off. . | |
| 0325533 | 7/1989 | European Pat. Off. . | |
| 114974 | 9/1975 | Fed. Rep. of Germany | 404/110 |
| 8506280 | 5/1985 | Fed. Rep. of Germany . | |
| 8631626 | 2/1987 | Fed. Rep. of Germany . | |
| 243951 | 3/1987 | Fed. Rep. of Germany | 404/111 |
| 2573455 | 5/1986 | France . | |
| 2626593 | 8/1989 | France | 404/76 |
| 882725 | 11/1961 | United Kingdom . | |
| 1420736 | 1/1976 | United Kingdom . | |
| 8804709 | 6/1988 | World Int. Prop. O. | 404/76 |

*Primary Examiner*—Kenneth J. Donner
*Assistant Examiner*—Nancy Connolly
*Attorney, Agent, or Firm*—Sandler Greenblum & Bernstein

[57] ABSTRACT

The apparatus for spreading a fluid or similar substance, especially a bonding emulsion for road asphalt onto the surface of a road, comprising, on a movable vehicle (1), at least one spreading boom (18, 19), along which the spreading is carried out at least partially, said boom being associated with at least one ejection nozzle (23, 24) and with a feed circuit (8; 106) and being capable of being displaced relative to the movable vehicle (1) transversely to the direction of movement of the latter, and is associated with motor means (30) intended for driving it in displacement, during spreading, in a to-and-fro movement. The machine of the finisher type comprises such an apparatus.

42 Claims, 6 Drawing Sheets

APPARATUS FOR SPREADING BONDING EMULSION OR SIMILAR MATERIAL FOR ROAD ASPHALT

FIELD OF THE INVENTION

The present invention relates to an appliance for spreading onto the surface of a road a bonding emulsion for road asphalt, a bituminous fluid substance or a similar fluid substance and to a road-building machine, especially of the finisher type, having such an appliance.

DESCRIPTION OF THE RELATED ART

It is known that the bonding of the various layers of the materials making a road (cement-bound sand and gravel, bitumen base course, road asphalt) is carried out by spreading a bonding emulsion before the application of the upper layer. For a long time, this emulsion layer has been deposited, before the passage of the finisher intended for laying down the road asphalt, by a machine of the spreader type comprising a tank and a spreading boom.

However, it emerged recently, as described in the document EP-A-292,337, that this procedure had many disadvantages:

- road spreaders which had a large bulk and low maneuverability were unsuitable for urban roadworks;
- furthermore, the finisher was supplied with road asphalt by means of lorries which, by rolling on the bonding layer not covered with bitumens, contributed, together with the crawler tracks of the finisher, to a partial removal of the bonding layer during the passage of their wheels, precisely in those parts of the road subsequently subjected to the greatest stress by the loads caused by the passage of heavy road vehicles;
- moreover, these spreaders generated dirt which was both troublesome and dangerous to users of the adjacent roads.

Now poor bonding systematically results in a weakness in the structure of the road and more rapid fatigue damage.

It was therefore proposed, especially in the abovementioned document EP-A-292,337, to carry out the deposition of the bonding layer just before the application of the road asphalt by the finisher. The apparatus provided by EP-A-292,337 combines the finisher with an independent chassis mounted on rolling means and moving ahead of the finisher at the same speed as the latter, the chassis serving for spreading the bonding layer.

However, this apparatus in no way prevents the crawler tracks of the finisher from rolling in the bonding layer, specifically in the parts of the bonding layer which are subsequently subjected to the greatest stress. Furthermore, above all, in practice the spreading booms with multiple orifices used on conventional binder spreaders prove completely unsuitable for this new apparatus: the spreading of the customary quantities of binder (quantities of 300 g per $m^2$ to 1.2 kg per $m^2$) on the ground is carried out by displacing the spreading boom at the speed of the finisher, that is to say at a much slower speed (3 m/min to 6 m/min) than that of conventional spreaders (30 m/min to 100 m/min); this assembly has to generate a somewhat low flow of binder since the orifices of the conventional spreading nozzles are no longer suitable and must have a very small diameter; they tend to become clogged as a result of the viscosity of the binders used.

SUMMARY OF THE INVENTION

The object of the present invention is, therefore, to overcome these various disadvantages. It provides, in particular, a spreading apparatus allowing a higher flow of binder per ejection nozzle, thus making it possible to reduce the risk of obstruction of the nozzles. The spreading apparatus according to the present invention carries out dynamic spreading by means of a to-and-fro movement of the binder jets over the width of the road, the jets extending over the ground with a high component according to the axis of advance of the finisher.

Furthermore, the apparatus provided by the invention has the advantage of being of sufficiently small bulk to be capable of being placed at the rear of the finisher, behind the crawler tracks of the latter, between the crawler tracks and the means for spreading the road asphalt onto the road.

It will also be noted that the apparatus provided by the invention requires no flexible pipeline for feeding it, thus likewise reducing its bulk and increasing its reliability. In particular, some alternate embodiments of the apparatus of the invention have the important characteristic of utilizing the binder emulsion as a hydraulic fluid for actuating the ejection nozzles.

The subject of the present invention is, therefore, an apparatus for spreading onto the surface of a road a bonding emulsion for road asphalt, a bituminous fluid substance or a similar fluid substance, comprising, on a movable vehicle, at least one spreading boom, along which the spreading is carried out at least partially, the boom being associated with at least one ejection nozzle and with a feed mechanism for the nozzle, characterized in that the nozzle is capable of being displaced, relative to the movable vehicle, transversely to the direction of movement of the latter and is associated with a motor mechanism intended for driving it in displacement, during spreading, in a to-and-fro movement.

Advantageously, an ejection nozzle is mounted on a box connected to the feed mechanism and intended for containing inside it a substance to be spread, in order to ensure the feed of the nozzle. A spreading boom comprises at least one hollow tube communicating with the interior of the box, one of the hollow tubes and the box being stationary relative to the vehicle and communicating with the feed mechanism for feeding the tube and the box, the other being capable of sliding relative to the first and carrying and feeding at least one ejection nozzle. A box is a box girder extending substantially over the length of a spreading boom, a tube partially extending substantially longitudinally in the box girder in order to come out of the latter at at least one of its ends, the tube communicating with the interior of the box girder by means of at least one orifice with which it is equipped, the tube and the box girder being capable of sliding relative to one another.

In an advantageous embodiment, a box girder is stationary relative to the vehicle and is associated with at least one tube partially extending longitudinally inside it, the tube carrying an ejection nozzle on a part located outside the box girder, the tube being capable of sliding longitudinally relative to the box girder. A box girder is associated, in particular, with two tubes, each carrying an ejection nozzle, each of these tubes passing through the box girder respectively at one of its ends.

In another advantageous embodiment, a box girder carries at least one nozzle and slides on a stationary tube which passes through it at at least one of its ends. A box girder can comprise, in particular, at least two nozzles distributed over its length. A box girder comprises, for example, one nozzle towards each of its ends. A tube extends from one end of a box girder to the other.

Preferably, the apparatus comprises at least two spreading booms, one of which is a central spreading boom allowing a spreading over substantially the width of the movable vehicle, the other being a lateral spreading boom allowing spreading on the side of the main width of the vehicle. The central spreading boom comprises a stationary tube extending substantially over an entire width of the movable vehicle and a box girder carrying at least one nozzle and capable of sliding on the stationary tube. The lateral spreading boom comprises a stationary box girder extending over substantially an entire width of the movable vehicle and associated with at least one tube carrying a nozzle, coming out of the box girder at one end of the latter and capable of sliding relative to the box girder.

In another embodiment, the apparatus comprises two stationary box girders each extending offset respectively over substantially a half-width of the vehicle and each associated with a sliding tube carrying a nozzle, coming out of the box girder, with which it is associated, in the region of the half-width of the other box girder.

Preferably, the substance to be spread is utilized in the motor mechanism as a hydraulic fluid. In particular, a tube capable of having a relative sliding movement in relation to a box girder is fixed to a piston which, in the box girder, delimits two chambers, each fed with substance to be spread, the pressure of the substance in these two chambers being adjusted in such a way that the tube is driven to slide under the effect of the differential pressure exerted on the piston. The tube has orifices for communication with each of the two chambers delimited by the piston in the box girder.

Should the tube be stationary, with the box girder carrying and feeding at least one ejection nozzle, the tube communicates with each of the two chambers via two parts separated sealingly from one another and each connected to the feed circuit.

Should the box girder be stationary, with the tube carrying and feeding an ejection nozzle, the tube is associated with at least one shutter intended for closing the orifice for the communication of the tube with that of the two chambers of the box girder in which the pressure of the material is the lower.

According to the present invention, a box girder is associated with two reversing valves, each chamber of the box girder being associated with a pipeline for the flow and backflow of the substance, each of these two valves being connected to each of these two pipelines and also being connected to a pipeline for feeding substance under pressure. One of the valves so connected to the substance feed pipeline to the flow and backflow pipeline associated with that of the two chambers of the box girder in which the pressure of the substance is the higher. The other of the two valves so connected to the pipeline associated with the other of the two chambers to a pipeline for return to the substance feed pipeline. The return pipeline to the substance feed pipeline has at least one discharge and/or pressure-regulating valve. The valves associated with the box girder are servo-valves which reverse automatically at the end of travel of the ejection nozzle or nozzles.

The motor mechanism can also comprise at least one hydraulic jack or one motor actuating a rack, the motor being a hydraulic motor.

The tube and box girder can be guided in their relative sliding by means of a piston fixed to the tube and arranged inside the box girder, the piston cooperating with the inner walls of the box girder and/or of a sleeve integral with the said tube and arranged outside the box girder, the inner walls of the sleeve sliding on the outer walls of the box girder.

Further, the ejection nozzle can be associated with a valve making it possible to control its closing and with gates of calibrated pressure.

Also advantageously, the jet of substance issuing from the ejection nozzle has, on the ground, a high component according to the direction of movement of the movable vehicle.

Another subject of the invention is a road-building machine of the finisher type comprising, on a chassis mounted a movement mechanism. A mechanism for spreading road asphalt and a mechanism for feeding the spreading mechanism, characterized in that it comprises an apparatus for spreading a bonding emulsion for the road asphalt onto the surface of a road. The apparatus for spreading a bonding emulsion is located at the rear of the chassis in relation to the direction of movement of the machine during the spreading of the road asphalt between movement mechanism of the machine and the spreading road asphalt.

Preferably again, the apparatus for spreading mechanism for spreading a bonding emulsion is arranged in the part of the feed mechanism which is located at the rear of the chassis in relation to the direction of movement of the machine during the spreading of the road asphalt; in particular, its feed conveyor being substantially raised and/or inclined in its rear part above the mechanism for spreading a bonding emulsion.

According to the present invention, machine comprising a control cab can have an emulsion reservoir mounted on the control cab; this reservoir is advantageously an interchangeable reservoir and is mounted on hydraulic jacks of adjustable height. The machine can comprise an emulsion-proportioning unit which comprises a proportioning pump feeding the nozzle or nozzles of the spreading appliance.

The following description is purely illustrative and non-limiting. It must be read in conjunction with the accompanying drawings.

Advantageously, a machine according to the invention comprises a mechanism for making it possible to heat or maintain the bonding emulsion at a temperature of approximately 80° C. The apparatus for spreading a bonding emulsion is capable of being dissociated from the chassis of the machine.

BRIEF DESCRIPTION OF DRAWINGS

Embodiments of the present invention are illustrated in the accompanying drawings wherein.

DETAILED DESCRIPTION OF THE INVENTION

Figure 1:
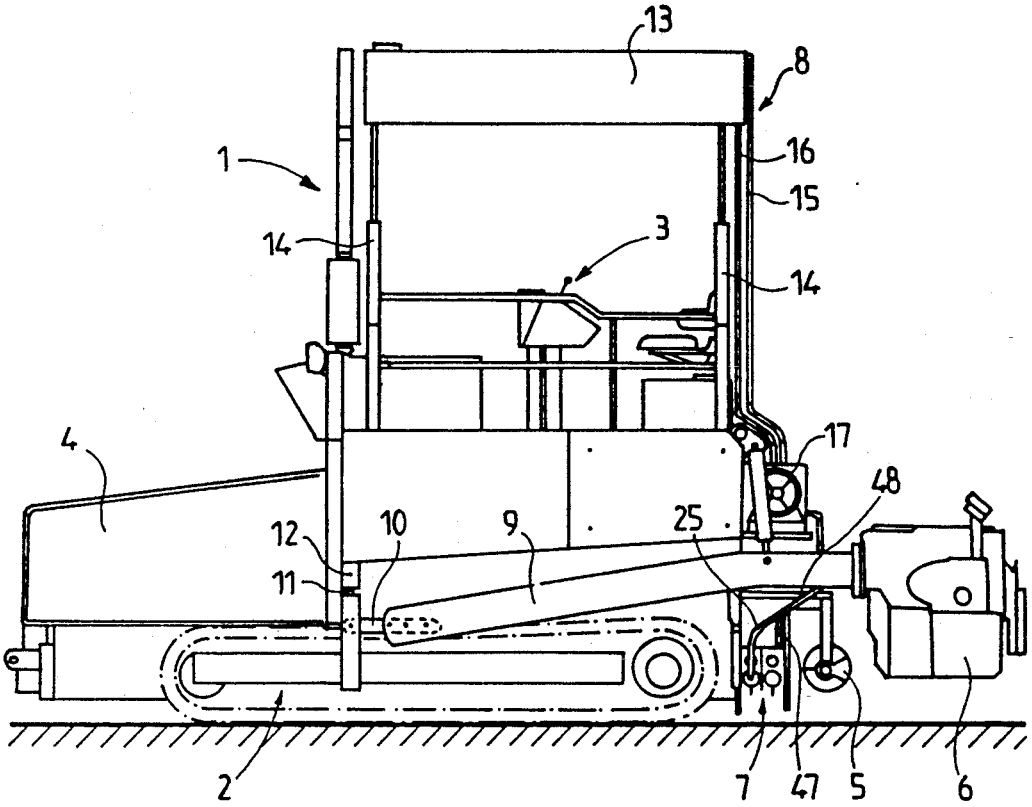
FIG. 1 is a side view of a machine of the finisher type, that is equipped with a spreading apparatus, according to one embodiment of the present invention.

Referring more particularly to FIG. 1, it can be seen that a machine of the finisher type according to the present invention, designated as a whole by 1, is mounted on crawler tracks 2 and comprises essentially a control cab 3, a hopper 4 for receiving road asphalt that is arranged at the front of the finisher, conventional means 5 for spreading road asphalt having a distributor screw and arranged at the rear of the finisher 1, a table 6 for smoothing the deposited road asphalt layers, and an apparatus 7 for spreading a bonding emulsion and associated with an emulsion feed mechanism, designated as a whole by 8.

The hot road asphalts are transferred in the conventional way from the hopper 4 to the road asphalt spreading means 5 by means of a transfer conveyor (not shown) arranged on the finisher 1 between the cab 3 and the part of the finisher 1 which carries the crawler tracks 2. This conveyor is raised slightly in its rear part above the spreading means 7. The smoothing table 6 is mounted at the rear of the finisher 1, beyond the road asphalt spreading means 5, on two bent arms 9 extending on each side of the vehicle substantially from the middle part of the crawler tracks to beyond the spreading means 5. These two arms 9 are articulated, at their end opposite the smoothing table 6, on spacers 10 mounted in the region of the crawler tracks 2, the inclination of the arms 9 relative to the plane of the ground determining the height of the smoothing table 6 and being adjusted by means of jacks 11, each extending between a fastening point on the spacer 10 and a fastening point 12 on the side of the tractor chassis in the extension of the floor of the cab 3 at the rear of the latter.

The feed mechanism 8 comprises essentially an emulsion reservoir 13 of a capacity greater than 2500 liters. This reservoir 13 is arranged above the cab 3 and extends substantially over the entire length of the latter. It is mounted on four hydraulic lifting jacks 14 extending perpendicularly relative to the floor of the cab 3, in the vicinity of each of the four ends of the latter. These jacks 14 make it possible to adjust the height of the reservoir 13 on the finisher 1 as desired; the reservoir 13 having, for example, a high position of use and a low storage position making it easier to transport the finisher 1. This reservoir 13 is a cartridge container which, if necessary, can be replaced during operation. The walls of this reservoir 13 have valve orifices intended for cooperating with the male ends of pipelines 15 and 16 which are feed and return pipelines connecting the reservoir 13 to a unit 17 for proportioning the binder emulsion. Moreover, the reservoir 13 is a thermally insulated reservoir which can be equipped with standby heating, for example electrical.

Figure 8:
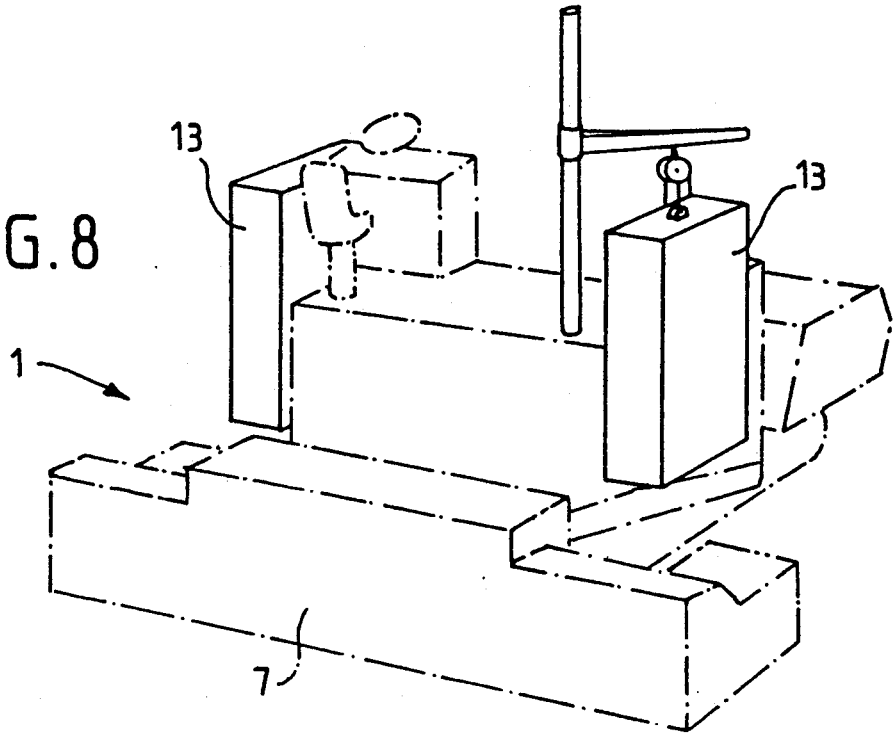
FIGS. 8 and 9 are representations of machines of the finisher type equipped with a spreading apparatus according to the present invention and according to other possible embodiments.

It is also possible, as shown diagrammatically in FIG. 8, to arrange the reservoirs 13 laterally on either side of the chassis of the machine. In particular, these arrangements allow a better balancing of the machine and a higher mechanical stability of its chassis.

Figure 9:
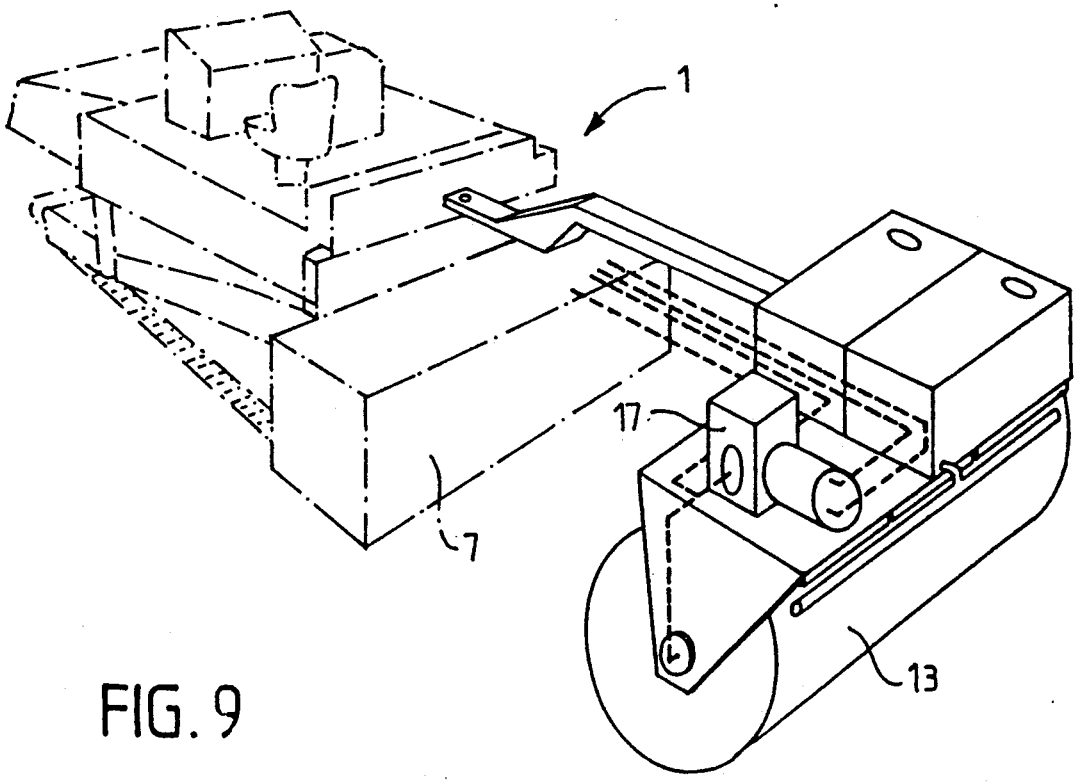

Yet again, it is possible to provide the reservoir at the rear of the finisher, as shown in FIG. 9, the reservoir 13 being, for example, a cylindrical tank rolling on the spread bitumen and compacting it. This rolling cylindrical tank 13 towed by the finisher would, of course, be associated with a proportioning pump 17, with radiant heating and with various other reservoirs (rinsing product, anti-stick product).

Figure 2:
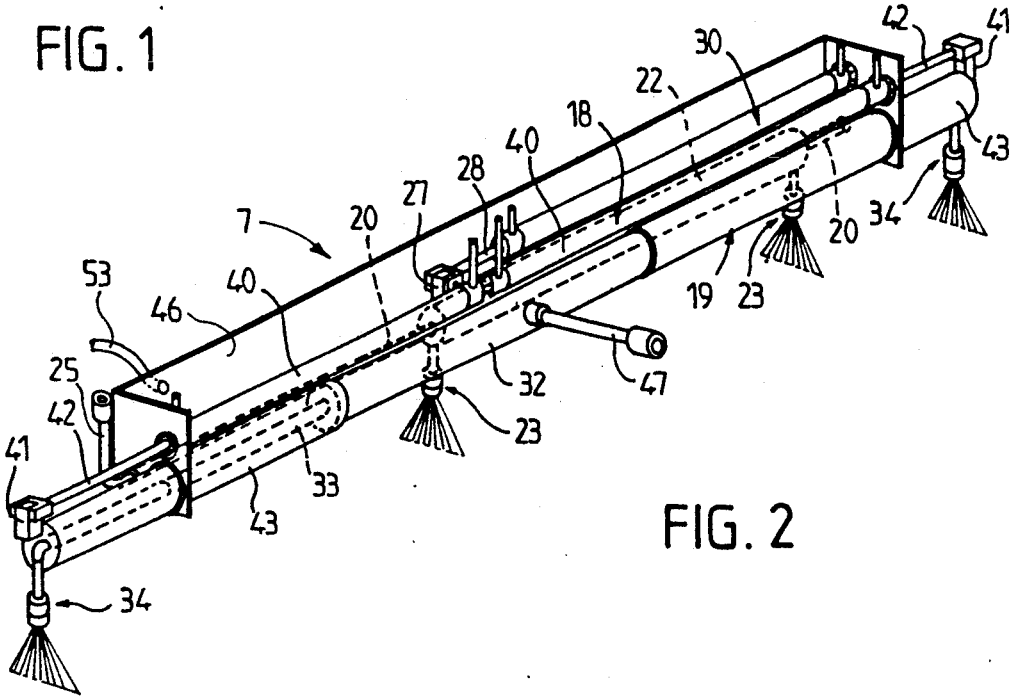
FIG. 2 is a diagrammatic perspective view of the spreading apparatus with which the machine of FIG. 1 is equipped.
Figure 3:
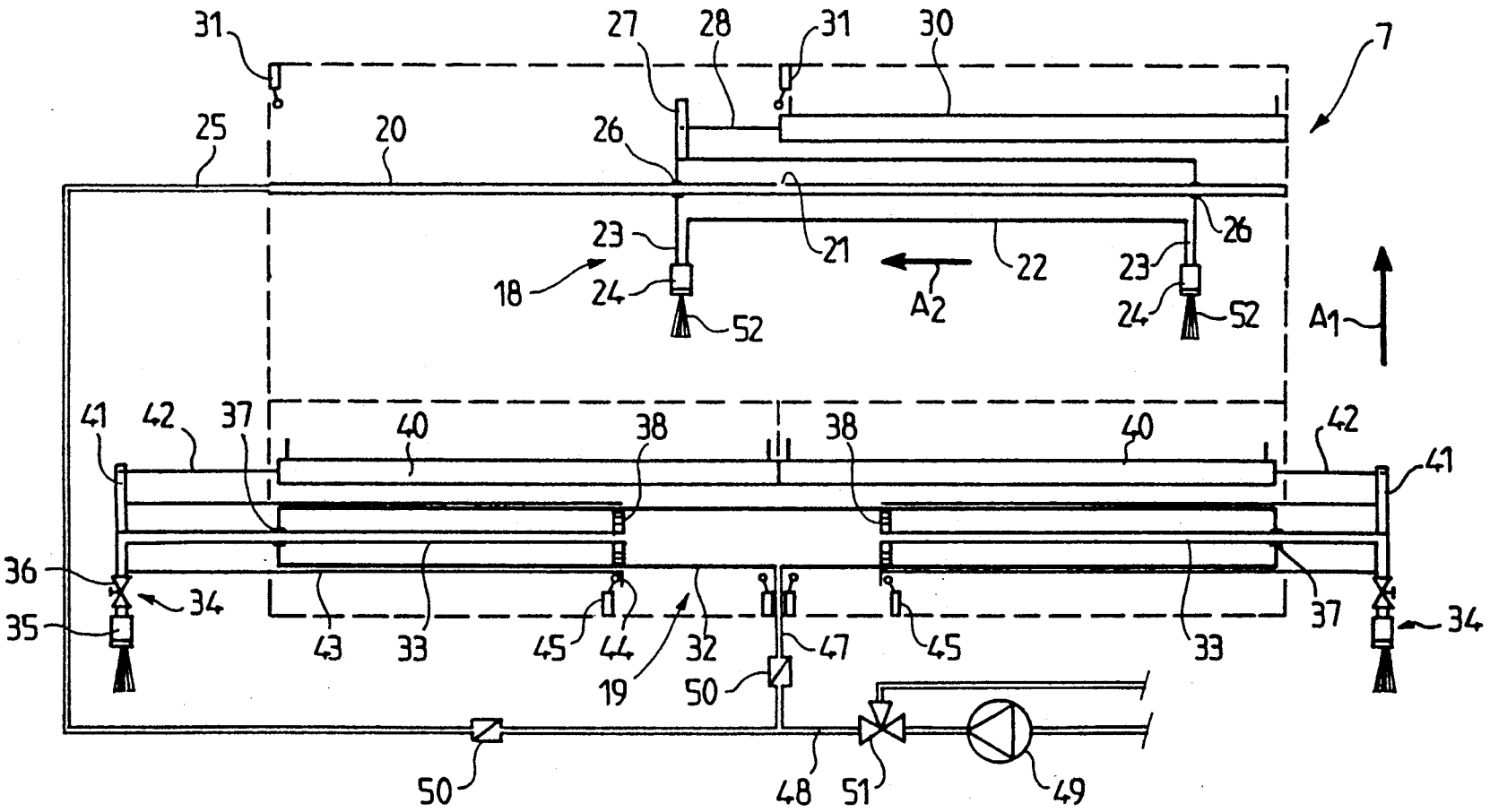
FIG. 3 is a diagrammatic representation of the spreading apparatus of FIG. 2.

Referring more particularly to FIGS. 2 and 3, it can be seen that the binder spreading apparatus 7 comprises two spreading booms 18 and 19 held in a right-angled parallelepipedic housing 46 extending over the base width of the finisher 1, the spreading boom 18 being a main boom intended for spreading the binder over the base width of the finisher 1, and the boom 19 being a secondary boom, itself serving for spreading the binder in the region of the right and left extra widths of the road on each side of the base width of the finisher 1.

The main boom 18 comprises essentially a hollow cylindrical tube 20 extending substantially over the entire base width of the finisher 1 and being stationary relative to the finisher 1. This tube 20 communicates by means of an orifice 21, with which it is provided at its center, with the interior of a box girder 22 extending longitudinally on the tube 20 which passes through it at each of its ends, the tube 20 and the said box girder 22 being coaxial. This box girder 22 is mounted movably in an axial translational motion on the said tube 20.

Towards each of its ends, the box girder 22 is equipped with an ejection nozzle 23 extending perpendicularly relative to the axis of the box girder 22 and intended for facing the road ground. Each ejection nozzle 23 is associated with a gate 24 of calibrated pressure. The tube 20 is closed sealingly at one of its ends, with its other end being extended by a pipeline 25 of the emulsion feed mechanism 8. The box girder 22 is equipped, in the region of its two lateral walls through which the tube 20 passes, with dynamic gaskets 26 ensuring the slidable sealing of the box girder 22 relative to the tube 20. At its end on the same side as the part of the tube 20 extended by the pipeline 25, the box girder 22 is extended on its upper part, substantially opposite the nozzle 23, by a spacer 27 connected to the sliding rod 28 of a double-acting hydraulic jack 30. This jack 30 extends along the tube 20 from the spacer 27 as far as the closed end of the tube 20. Also mounted on the finisher 1, in the region of the upper part of the spacer 27 and on the opposite side to the jack 30 in relation to the orifice 21, are stroke-adjusting contacts 31 that are connected to a control circuit (not shown) for the movement of the jack 30. The jack 30 thus serves as a motor means for generating on the box girder 22 a to-and-fro movement between the two positions in which the spacer 27 is level with the stroke-adjusting contacts 31. The position of the stroke contacts 31 along the tube 20 is adjustable, thereby making it possible to match the stroke of the nozzles 23 to the width of the road when the latter is less than the base width of the finisher 1.

The extendable secondary boom 19 itself comprises essentially a box girder 32, stationary relative to the finisher 1 and extending over the entire base width of the finisher 1; the booms 18 and 19 being arranged one behind the other at the rear of the finisher 1. This box girder 32 is associated with two tubes 33 of the same type as the tube 20, which are coaxial with box girder 32 and which each pass through box girder 32 respectively at one end. These two tubes 33 are open at their end inside the box girder 32 and each open, at their end outside the box girder 32, out onto an ejection nozzle 34. Each ejection nozzle 34 extends towards the ground relative perpendicularly to the tube 33 with which it is associated, and is equipped with a calibrated gate 35 and with a valve 36 controlling its opening or closing. The box 32 is associated, in the region of its walls through which the tubes 33 pass, with dynamic gaskets 37 ensuring the sealing of the apparatus. The tubes 33 moreover are equipped, at their ends inside box girder 32 with pistons 38 which are pierced disks, to allow the passage of the emulsion, the outside diameter of which corresponds substantially to the inside diameter of the box girder 32 and which serve for guiding the movement of the tubes 33 within the box girder 32.

Each tube 33 is associated with a double-acting hydraulic jack 40 extending along the box girder 32 from the middle part of the latter to as far as a spacer 41 fixed to the end of the said tube 33 carrying a nozzle 34, with spacer 41 being connected to the movable rod 42 of the hydraulic jack 40. Furthermore, each tube 33 is also guided in translational movement relative to the box girder 32 by the inner walls of a sleeve 43 sliding along the outer walls of the box girder 32, with the inside diameter of sleeve 43 corresponding substantially to the outside diameter of the box girder 32. At its end opposite the nozzle 34 of the tube 33 with which it is associated, each sleeve 43 comprises a tab 44 turned outwards and intended for cooperating with two stroke-adjusting contacts 45, making it possible to control the to-and-fro movement of a tube 33 relative to the box girder 32. These contacts 45 are also adjustable relative to the finisher 1, in such a way that the stroke of the nozzles 34 is matched to the extra road width to be covered by the nozzle 34. The housing 46 can easily be dissociated from the chassis of the finisher 1, to which it is fixed by engaging in a complementary recess. For this purpose, the pipelines 25 and 47 are capable of being disconnected easily from the pipeline 48 which is connected to them by means of self-closing quick-connection connectors.

A pipeline 47 of the emulsion feed circuit 8 opens out inside the box girder 32 substantially in its middle part. This pipeline 47 and the pipeline 45 are both fed via the intake of a pipeline 48 connected to a binder-proportioning pump 49 integrated in the proportioning unit 17. Each of the pipelines 25 and 47 is equipped with a non-return valve 50. The pipeline 48 is itself associated, between the pump 49 and the pipelines 47 and 25, with a bleed valve 51. The housing 46 is advantageously associated with a nozzle 53 making it possible to blow into it hot air intended for maintaining the box girders 22 and 32 at a temperature equal to approximately 80° C. The pipelines 15, 16, 25 and 47 are themselves associated with heating cords.

In a possible further embodiment which is not shown, the box girder of the main boom comprises four nozzles distributed over its length, instead of two. The extension tubes of the secondary booms each comprise two inner atomizers distributed over their length. Depending on the width of the road onto which the spreading is carried out, users can adjust the extension length of these tubes and on each side employ the two atomizers or only one or even neither of these.

During operation, the box girders 22, 32 and the tubes 20, 33 associated with them contain inside them emulsion maintained under pressure by means of the proportioning pump 49. If the pressure of the emulsion is sufficient, the calibrated gates 24 of the nozzles 23 will open to allow to pass the emulsion jets 52, which extend substantially to the ground in the direction of advance of the finisher 1. The same will apply to the gates 35 of the nozzles 34 when the valves 36 have previously been opened.

Figure 4:
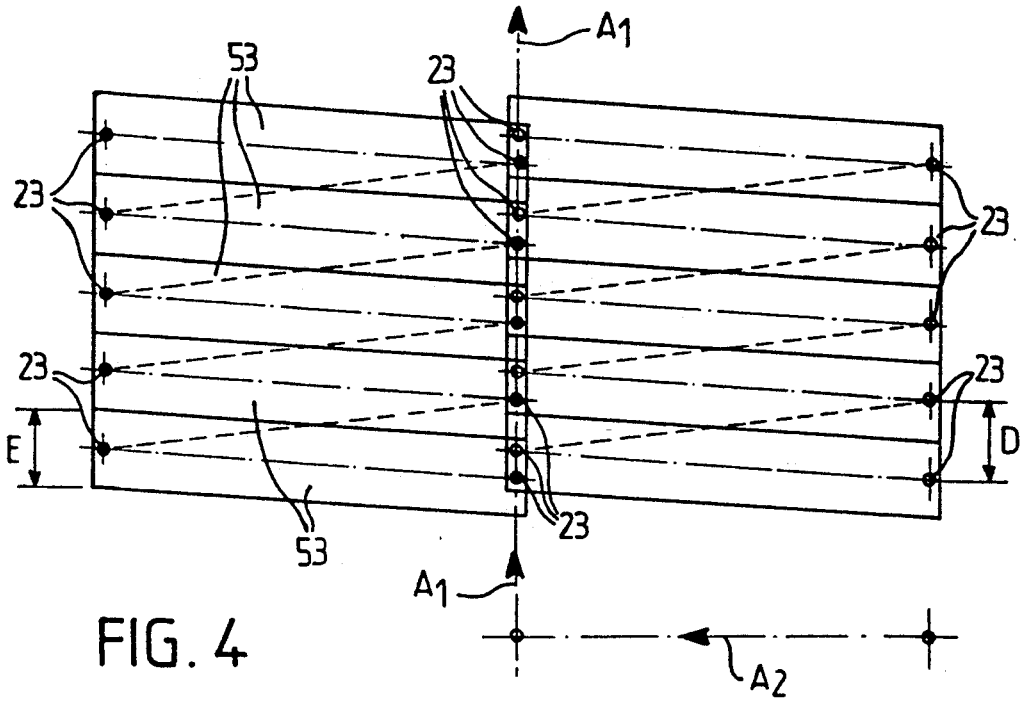
FIG. 4 illustrates a kinematic diagram of the spreading of bonding layers on a road, carried out with the spreading of FIGS. 2 and 3, without the use of extra widths.

Starting from a position in which that of the two ends of the box girder 22 which faces the jack 30 is substantially in the region of the closed end of the tube 20, the box girder 22 carries out, as shown more particularly in FIG. 4, a spreading of binder in successive layers 53 having a contour of a parallelogram, the main length of which is slightly oblique relative to the direction in which the base width of the finisher 1 extends because of the combination of the advance A1 of the finisher 1 and of the displacement A2 of the ejection nozzles 23 relative perpendicularly to the advance A1. After an outward travel, the cooperation of the spacer 27 and of one of the contacts 31 controls the return travel of the box girder 22. The apparatus 7 and the movement of the nozzles are governed by the speed and/or displacement of the finisher 1. The synchronization of the movements of the jack 30 and of the advance of the finisher 1 will advantageously be adjusted in such a way that, during a to-and-fro movement of the nozzles 23 along the boom 18, the finisher 1 has advanced a distance D coinciding with the component of the jets on the ground along the direction of advance of the finisher 1, a high value preferably being selected for this component.

During a return travel, it is possible to either maintain the pressure of the emulsion in the tube 20 and the box girder 22 at the pressure of the outward travel or, by means of the pump 49, command a sufficient decrease of this pressure to ensure that the calibrated gates 24 resume the closing position. In the first instance, the ejection nozzles continue to spread the binder emulsion onto the road during their return travel; the spreading carried out is a Z-shaped spreading with a partial successive overlap of the binder layers by one another. In the second instance, as shown in FIG. 4, the nozzles 23 do not spread during the return travel; the spreading carried out is a spreading in parallel layers 53 which, if appropriate, can overlap along their lateral lengths.

The operating principle of the nozzles 34 in the region of the extra widths of the road is, of course, substantially identical.

Figure 5:
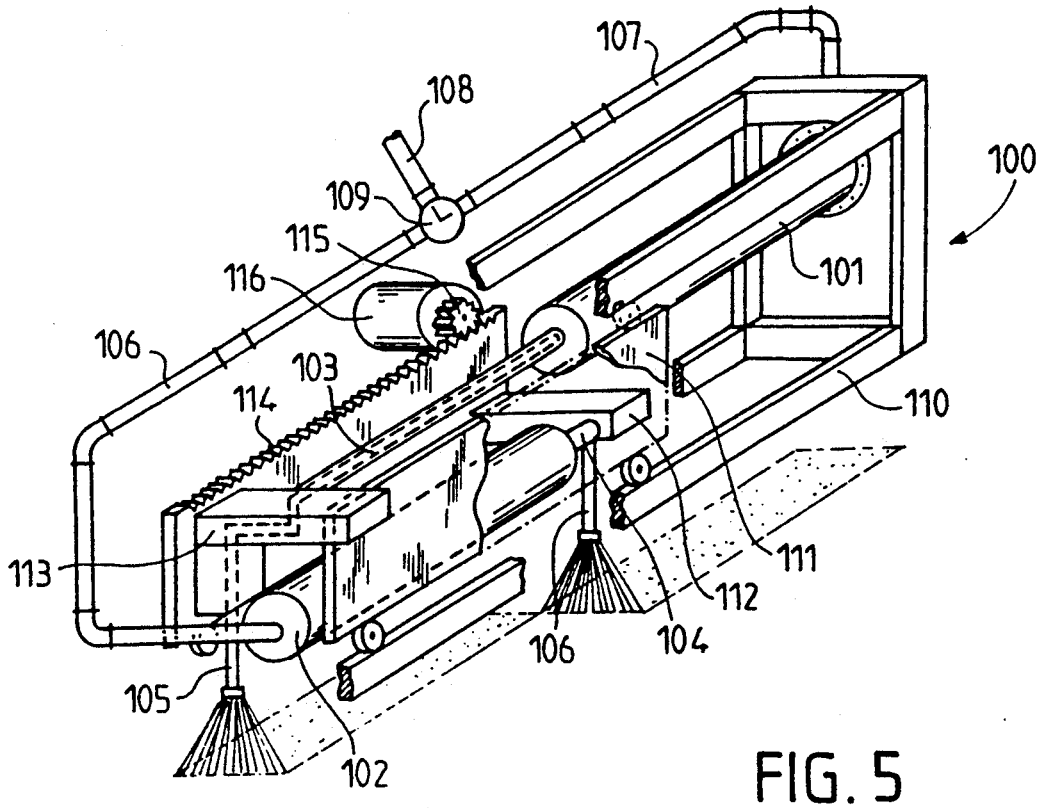
FIG. 5 is a diagrammatic perspective representation of a spreading apparatus according to a second embodiment of the present invention.

Further embodiments of the above-described apparatus are also possible. In particular, FIG. 5 illustrates a spreading apparatus according to a second embodiment of the invention.

Third apparatus 100 comprises, over the base width of the finisher, two box girders 101, 102 extending offset relative to one another in the direction of advance of the finisher, each over a half-width of the latter. Each box girder 101, 102 is associated with a tube, designated respectively by 103 and 104, extending partially inside it and coming out of the box girder 101, 102 at the end of the latter near the middle of the width of the finisher. Each of these tubes 103, 104 is extended by a respective ejection nozzle 105 or 106 at its end outside the box girder 101 or 102 with which it is associated. Since the tubes 103, 104 are mounted slidably in the box girders 101, 102, each of the nozzles 105 or 106 is intended for sweeping, in a manner offset relative to one another, over half the base width of the finisher with which it is associated.

A binder feed pipeline 106 or 107 opens into each box girder 101 or 102 at its end opposite the tube 103 or 104 with which it is associated. The pipelines 106 and 107 are themselves fed by a common intake pipeline 108, the binder intake being controlled by a reversing valve 109.

The assembly is mounted on a support 110 which extends over the base width of the finisher and on which a carriage 111 connected to the nozzles 105, 106 by respective spacers 112, 113 can roll. This carriage 111 is driven in movement over the base width of the finisher on the support 110 by motor means comprising a rack 114 fastened to the carriage and cooperating with a gearwheel 115 actuated by the shaft of a hydraulic motor 116 fastened to the support 120 The hydraulic circuit of this motor 116 is integrated in the circuit of the finisher. The spacers 112, 113 are distributed in such a way that, when the tube 104 is in its end position retracted relative to the box girder 102, the tube 103 is in its end position extended relative to the box girder 101, and vice versa. Here again, as a result of the combination of the advance of the finisher and of the movement of the nozzles over the width of the latter, the spreading will be carried out in layers substantially oblique relative to the direction of displacement of the finisher.

Figure 6:
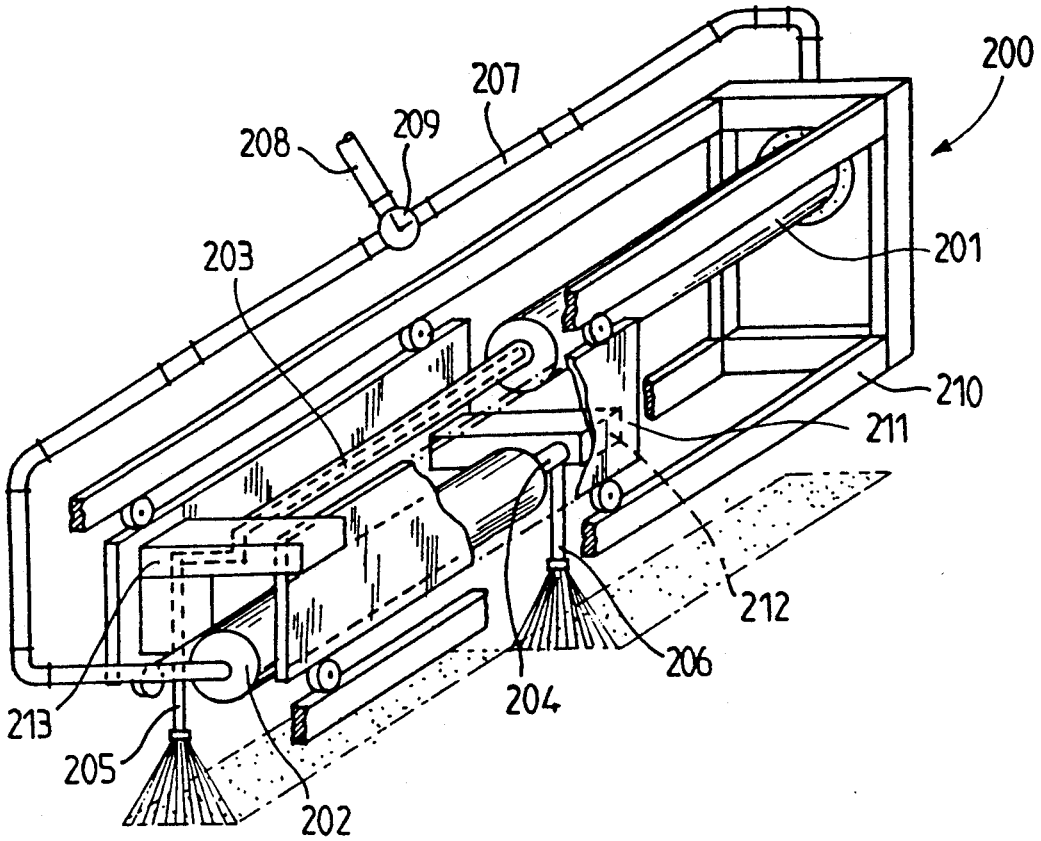
FIG. 6 is a diagrammatic perspective representation of a spreading apparatus according to a third embodiment of the present invention.

FIG. 6 illustrates one possible further embodiment of the apparatus of FIG. 5. The same reference numerals increased by 100 have been readopted for the elements of the apparatus of FIG. 5 which are found again on the apparatus of this embodiment. For this new apparatus, only the motor means of the carriage 211 have been changed in relation to the apparatus of FIG. 5, in this new further apparatus the carriage 211 essentially performing a function of supporting the tubes 203, 204 and of coordinating and synchronizing their respective movements in relation to the finisher.

The tubes 203, 204 are driven in movement by means of the emulsion under pressure, the emulsion being used as hydraulic fluid, each box-girder 201–202/tube 203–204 assembly serving as a hydraulic jack, which execute an extending movement driving each other in a retracting movement by means of the carriage 211. The emulsion feed circuit, which has not been described fully here, will advantageously be of the type described later for further embodiments of the invention.

Figure 7:
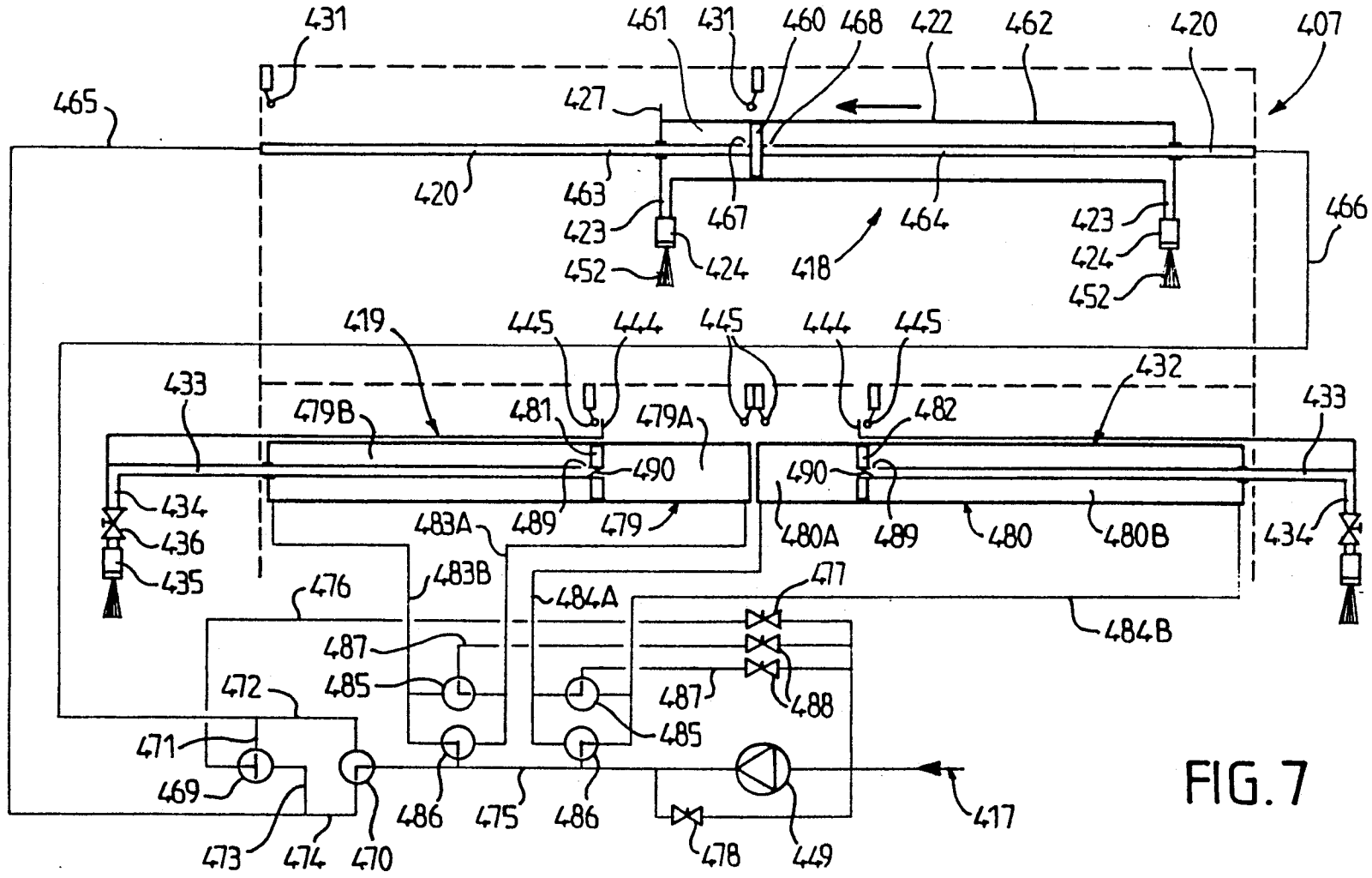
FIG. 7 is a diagrammatic representation of an apparatus similar to that of FIGS. 2 and 3 and according to a fourth embodiment of the present invention.

Another possible alternate embodiment of the spreading apparatus provided by the invention has also been illustrated in FIG. 7.

This other apparatus is substantially similar to that shown in FIGS. 2 and 3, and the same reference numbering increased by 400 has been readopted for the elements of the apparatus illustrated in FIGS. 2 and 3, which are found again on the apparatus of this FIG. 8.

This spreading apparatus 407 comprises, in particular, a main spreading boom 418 associated with a lateral spreading boom 419.

The main boom 418 comprises, on a hollow tube 420 stationary relative to the finisher, a box girder 422 capable of sliding on the tube 420. Towards each of its ends, box girder 422 is associated, with two adjusting contacts 431 controlling its to-and-fro movement between two positions on the tube 420. The lateral boom 419 itself comprises essentially a box girder 432 that is stationary relative to the finisher and associated with two tubes 433, 433, each coming out at one of the ends of the box girder 432. Each tube 433 comprises an ejection nozzle 434 outside the box girder 432 and is associated with a tab 444 intended for cooperating with contacts 445 in order to control the to-and-fro movement of tube 433 in relation to the box girder 432.

The tube 420 is associated at its center with a piston 460 which separates the box girder 422 into two chambers 461, 462 and which also separates the tube 420 sealingly into two parts 463 and 464. The chamber 461 and the part 463 of the tube 420 are on the same side in relation to the piston 460. Each of the parts 463 and 464 is extended respectively by a pipeline 465, 466 serving for the flow and backflow of the material. Moreover, each of these parts 463, 464 communicates respectively with the chamber 461 and the chamber 462 by way of an orifice 467, 468 which passes through the wall of the tube 420 forming the end of the piston 460.

This main boom 418 is associated with two reversing valves 469, 470, each with three inlets, only two of which are in communication. Each of these two valves 469, 470 is connected respectively to the pipeline 466 by means of an inlet 471, 472 and to the pipeline 465 by means of an inlet 473, 474. The third inlet of the valve 470 is connected to a binder feed pipeline 475, at which the bonding emulsion put under pressure by a pump 449 of the proportioning unit 417 arrives. The third inlet of the valve 469 is itself connected to a branch circuit 476 which returns the binder to the pipeline 475 after passage through a discharge valve 477 discharging into the feed circuit. A valve 475 is mounted as a by-pass relative to the pump 449 to ensure the regulation of the pressure of the binder circuit as a whole.

The box girder 432 is itself separated into two secondary box girders 479–480 that are distributed on each side of its middle part. The two tubes 433, 433 respectively associated with each of these two secondary box girders 479–480 are both equipped, at their end farthest from the nozzle 434 which each carries, with a piston designated respectively by 481 and 482 and sealingly separating the box girder 479–480 in which it is located into two chambers designated respectively by 479A, 479B and 480A, 480B. Each of these two chambers is extended at its ends by flow and backflow pipelines designated respectively by 483A and 483B for the box girder 479 and by 484A and 484B for the box girder 480. Moreover, the box girders 479 and 480 are each associated respectively with two valves which are designated by 485 and 486 and have three inlets and which, in relation to the flow and backflow pipelines 483A, 483B and 484A, 484B, perform the same function as the valves 469, 470 in respect of the pipelines 465 and 466, the valves 485 each being associated with a branch circuit 487 associated with a discharge valve 488, the three circuits 467 and 487 discharging into the feed circuit.

Furthermore, each tube 433 passes through the piston 481, 482 with which it is associated, in order to open respectively into the chamber 479A, 480A, its part which extends respectively in the chamber 479B, 480B being equipped, towards the piston 481 or 482, with an orifice 489 allowing the flow in the chamber 479B or 480B to communicate with the nozzle 434 carried by the tube 433 with which the chamber is associated. This orifice 489 is completed by a relief shutter 490 putting the tube 433 alternately in communication with that of the two chambers 479A and 479B or 480A and 480B in which the emulsion is under the highest pressure.

Such an apparatus operates as follows: as in FIG. 8, when the valve 469 puts the pipeline 466 in communication with the branch circuit 476 and the valve 470 puts the pipeline 465 in communication with the feed pipeline 475, the pressure maintained in the chamber 461 imparts to the box girder 422 a movement in the direction indicated by the arrow shown in FIG. 8. In the chamber 462, the delivered binder is set in motion again by the tube 420 in the pipeline 466 as far as the valve 469 which reinjects it, by means of the branch circuit 476, in the region of the pipeline 475 which, by means of the pump 449, feeds the valve 470 and the chamber 461.

At the end of travel of the box girder 422, the cooperation. of the spacer 427 and of the contact 431 located at the end of the tube 420 extended by the pipeline 465 controls the actuation of the valves 471 and 472, in such a way that the emulsion circuit and the movement of the box girder 462 are reversed.

The operation of the extendable secondary boom for covering the right and left extra widths on either side of the finisher is substantially identical.

The machines and apparatuses described above are advantageously used for spreading aqueous bitumen emulsions spread simultaneously with one or more emulsion breakdown agents, so that the breakdown of the emulsion takes place in the mass according to the process developed by COLAS S. A. under the trade name of Emulcol and described particularly in their patent FR 2,573,455.

We claim:

1. An apparatus for spreading a bonding emulsion substance onto the surface of a road, said apparatus comprising:

at least one spreading boom on a movable vehicle, along which spreading is at least partially carried out; and feed means for controlling the feeding of the substance to be spread, wherein said boom comprises at least one ejection nozzle, connected to said feed means and being displaceable transversely to the direction of movement of the movable vehicle, and motor means for driving said nozzle transversely to the direction of movement of the vehicle during spreading.

2. The apparatus according to claim 1, wherein said ejection nozzle is mounted on a box connected to said feed means, and said box contains the substance to be spread.

3. The apparatus according to claim 2, wherein said spreading boom comprises hollow tubes communicating with the interior of said box, one of said hollow tubes being stationary relative to the vehicle and communicating with said feed means, another of said hollow tubes being slidable relative to said stationary hollow tube and carrying and feeding the substance to be spread to at least one of said ejection nozzles.

4. The apparatus according to claim 3, wherein said box comprises a box girder extending substantially over the length of said spreading boom and at least one of said hollow tubes partially extending substantially longitudinally in said box girder and capable of extending out from at least one of the ends of said box girder, said hollow tube communicating with the interior of said box girder by means of at least one orifice; said hollow tube and said box girder being slidable relative to one another.

5. The apparatus according to claim 4, wherein said box girder is stationary relative to the movable vehicle and comprises at least one tube partially extending longitudinally, said tube having at least one ejection nozzle outside of said box girder and slidable longitudinally with respect to said box girder.

6. The apparatus according to claim 5, wherein said box girder comprises at least two tubes each having at least one of said ejection nozzles, said tubes each passing through one of the ends of said box girder.

7. The apparatus according to claim 4, wherein said box girder comprises at least one of said ejection nozzles that is slidable relative to a stationary tube which passes through at at least one of the ends of said box girder.

8. The apparatus according to claim 7, wherein said box girder comprises at least two of said ejection nozzles distributed over the length of said box girder.

9. The apparatus according to claim 8, wherein said ejection nozzles are located substantially towards each of the ends of said box girder.

10. The apparatus according to claim 7, wherein said stationary tube extends from one end of said box girder to the other end of said box girder.

11. The apparatus according to claim 1, wherein said spreading boom comprises a central spreading boom for spreading substantially over the width of the movable vehicle and a lateral spreading boom for spreading substantially laterally with respect to the width of the movable vehicle.

12. The apparatus according to claim 11, wherein said central spreading boom comprises a stationary tube extending substantially over the entire width of the movable vehicle and a box girder comprising at least one of said ejection nozzles that is slidable relative to said stationary tube.

13. The apparatus according to claim 12, wherein said lateral spreading boom comprises at least one stationary box girder extending substantially over the width of the movable vehicle and having at least one tube carrying an ejection nozzle, said tube being slidable relative to said box girder.

14. The apparatus according to claim 5, further comprising two stationary box girders each extending substantially over a half-width of the movable vehicle and each having a sliding tube carrying an ejection nozzle, said sliding tubes slidably coming out at an end of said stationary box girders, respectively.

15. The apparatus according to claim 1, wherein said substance to be spread is utilized in said motor means as a hydraulic fluid.

16. The apparatus according to claim 4, wherein said hollow tube slidable relative to said box girder is fixed to a piston located in said box girder which delimits two chambers that are each fed with the substance to be spread, the pressure of the substance in said chambers being adjusted so that said hollow tube is driven to slide in accordance with the differential pressure exerted on said piston.

17. The apparatus according to claim 16, wherein said hollow tube further comprises orifices for communication with each of said two chambers delimited by said piston in said box girder.

18. The apparatus according to claim 3, wherein said box girder carries and feeds at least one ejection nozzle and said stationary tube includes a piston which separates said box girder into two chambers that are each fed with the substance to be spread, said piston further separates said stationary tube sealingly into two parts that are each connected to said feed means.

19. The apparatus according to claim 17, wherein said box girder is stationary, said hollow tube carrying and feeding an ejection nozzle and comprising at least one shutter for closing the orifice for communication of said tube with said two chambers, wherein the pressure of the substance in said two chambers is substantially lower than the pressure of the substance in said tube.

20. The apparatus according to claim 16, wherein said box girders comprise two reversing valves, and each of said two chambers comprises a pipeline for the flow and for the backflow of the substance, each of said reversing valves being connected to one of said flow and backflow pipelines and to another pipeline for feeding the substance under pressure, one of said reversing valves connecting said substance feed pipeline to said flow and backflow pipeline of one of said chambers, wherein the pressure of the substance in said chamber is substantially higher than the pressure of the substance in said feed pipeline, the other of said reversing valves connecting said flow and backflow pipeline associated with the other of said chambers to a return pipeline for return of the substance to said substance feed pipeline.

21. The apparatus according to claim 20, wherein said return pipeline to said substance feed pipeline comprises at least one pressure regulating valve.

22. The apparatus according to claim 20, wherein said valves of said box girder are servo-valves which reverse automatically at the end of the displacement of said ejection nozzles.

23. The apparatus according to claim 1, wherein said motor means comprises at least one hydraulic jack.

24. The apparatus according to claim 1, wherein said motor means comprises a motor actuating a rack.

25. The apparatus according to claim 24, wherein said motor means comprises a hydraulic motor.

26. The apparatus according to claim 1, further comprising a tube and a box girder relatively slidingly guided by a piston that is integral with said tube and arranged inside said box girder, said piston cooperating with inner walls of a sleeve integral with said tube and arranged outside of said box girder, said inner walls of said sleeve sliding on outer walls of said box girder.

27. The apparatus according to claim 1, wherein at least one of said ejection nozzles comprises a valve for controlling the closing and opening of said ejection nozzle.

28. The apparatus according to claim 1, wherein at least one of said ejection nozzles comprises a calibrated pressure gate.

29. The apparatus according to claim 1, wherein a jet of substance issuing from said ejection nozzles has a high component force vector on the ground in the direction of movement of the movable vehicle.

30. The apparatus according to claim 1, further comprising a roading building machine of the finisher type comprising spreading means, mounted on the chassis of the movable vehicle, for spreading road asphalt and means for feeding the road asphalt to said spreading means, wherein said spreading means comprises means for spreading the bonding emulsion substance.

31. The machine according to claim 30, wherein said means for spreading the bonding emulsion substance is located at the rear of the chassis in relation to the direction of movement of the machine during the spreading of the road asphalt.

32. The machine according to claim 31, wherein said means for spreading the bonding emulsion substance is arranged between said means for feeding the road asphalt and said means for spreading the road asphalt.

33. The machine according to claim 32, wherein said means for spreading the bonding emulsion substance is located substantially under a portion of said road asphalt feeding means that is located at the rear of the chassis in relation to the direction of movement of the machine during the spreading of the road asphalt.

34. The machine according to claim 33, wherein said road asphalt feeding means comprises a feed conveyor for conveying road asphalt from an area towards the front part of the machine to an area towards the rear part of the machine, wherein a rear portion of said feed conveyor is substantially inclined above said means for spreading the bonding emulsion substance.

35. The machine according to claim 30, further comprising a control cab comprising an emulsion reservoir mounted thereon.

36. The machine according to claim 35, wherein said emulsion reservoir is an interchangeable reservoir that is mounted on at least one hydraulic jack of adjustable height.

37. The machine according to claim 30, further comprising an emulsion proportioning unit comprising a proportioning pump feeding at least one of said ejection nozzles of said spreading boom.

38. The machine according to claim 30, further comprising means for maintaining the bonding emulsion substance at a temperature of approximately 80° C.

39. The machine according to claim 30, wherein said means for spreading the bonding emulsion substance is detachably attached to the chassis of the machine.

40. The apparatus according to claim 1, wherein the bonding emulsion spreading is a simultaneous spreading of an aqueous bitumen emulsion and of at least one emulsion breakdown agent.

41. The machine according to claim 30, wherein the spreading is a simultaneous spreading of an aqueous bitumen emulsion and of at least one emulsion breakdown agent.

42. The apparatus according to claim 20, wherein said return pipeline to said substance feed pipeline comprises at least one discharge valve.

* * * * *

UNITED STATES PATENT AND TRADEMARK OFFICE

CERTIFICATE OF CORRECTION

PATENT NO. : 5,324,136

DATED : June 28, 1994

INVENTOR(S) : Jean-Pierre REYMONET et al.

It is certified that error appears in the above-indentified patent and that said Letters Patent is hereby corrected as shown below:

At the cover sheet, Item [57], lines 1-13, the Abstract should be replaced with the following:

---An apparatus is provided for spreading a fluid or similar substance, especially a bonding emulsion for road asphalt, onto the surface of a road. The apparatus comprises, on a movable vehicle, at least one spreading boom along which the spreading is carried out and comprising at least one ejection nozzle that is displaceable transversely to the direction of movement of the vehicle, and a feed mechanism for controlling the feeding of the substance to be spread. The apparatus further comprises a motor for transversely displacing the ejection nozzle during spreading.---.

At column 3, line 63, change "so" to ---is---.

At column 5, line 3, after "spreading" insert ---apparatus---.

At column 8, line 59, change "Third" to ---This---.

Signed and Sealed this

Twenty-eighth Day of May, 1996

*Attest:*

Bruce Lehman

BRUCE LEHMAN

*Attesting Officer*

*Commissioner of Patents and Trademarks*